US006677057B2

(12) United States Patent
Kim

(10) Patent No.: US 6,677,057 B2
(45) Date of Patent: Jan. 13, 2004

(54) ZN-CO-W ALLOY ELECTROPLATED STEEL SHEET WITH EXCELLENT CORROSION RESISTANCE AND WELDABILITY, AND ELECTROLYTE FOR PLATING SAME

(75) Inventor: Myung-Su Kim, Pohang-si (KR)

(73) Assignee: Posco (KR)

( * ) Notice: Subject to any disclaimer, the term of this patent is extended or adjusted under 35 U.S.C. 154(b) by 0 days.

(21) Appl. No.: 10/204,512

(22) PCT Filed: Dec. 10, 2001

(86) PCT No.: PCT/KR01/02136

§ 371 (c)(1),
(2), (4) Date: Aug. 21, 2002

(87) PCT Pub. No.: WO02/052068

PCT Pub. Date: Jul. 4, 2002

(65) Prior Publication Data

US 2003/0064243 A1 Apr. 3, 2003

(30) Foreign Application Priority Data

Dec. 22, 2000 (KR) ..... 2000/80870

(51) Int. Cl.[7] ..... C25D 3/22; C25D 3/56; B32B 15/01

(52) U.S. Cl. ..... 428/659; 428/935; 205/245

(58) Field of Search ..... 428/659, 935, 428/668, 665; 205/245; 106/1.17, 1.29

(56) References Cited

U.S. PATENT DOCUMENTS

| | | | | | |
|---|---|---|---|---|---|
| 3,791,801 | A | | 2/1974 | Ariga et al. | |
| 4,290,860 | A | * | 9/1981 | Matsudo et al. | 205/155 |
| 4,366,034 | A | | 12/1982 | Ricks et al. | |
| 4,650,724 | A | * | 3/1987 | Umino et al. | 428/659 |
| 6,500,886 | B1 | * | 12/2002 | Yamamuro et al. | 524/99 |

FOREIGN PATENT DOCUMENTS

| | | | | |
|---|---|---|---|---|
| JP | 47-016522 | * | 5/1972 | 205/245 |
| JP | 53-112232 | * | 9/1978 | |
| JP | 57-029598 | * | 2/1982 | |
| JP | 57-114686 | A | 7/1982 | |
| JP | 59-025992 | * | 2/1984 | |
| JP | 61-096096 | A | 5/1986 | |
| JP | 63-065084 | * | 3/1988 | |
| JP | 09-228067 | A | 9/1997 | |
| JP | 11-229176 | A | 8/1999 | |
| JP | 2002-075238 | * | 3/2002 | |

* cited by examiner

*Primary Examiner*—John J. Zimmerman
(74) *Attorney, Agent, or Firm*—Webb Ziesenheim Logsdon Orkin & Hanson, P.C.

(57) ABSTRACT

A Zn—Co—W alloy electroplated steel sheet with excellent corrosion resistance and weldability, and an electrolyte for manufacturing same are provided. The plating layer consisting of Co: 0.1–3.0 wt %, and zinc: balance, is formed on the steel sheet and all tungsten plating is carried out with metallic tungsten; an electrolyte for manufacturing a Zn—Co—W alloy electroplated steel sheet, comprising zinc chloride: 60–200 g/l, cobalt chloride: 0.1–6.0 g/l, tungsten: 0.1–4.0 g/l, citric acid: 0.5–10.0 g/l, polyethylene glycol: 0.1–2.0 m/l and electric conductive aid: 30–400 g/l, wherein substantially all of the tungsten ions form a complex compound with citric acid, thereby preventing formation of sludge; and a Zn—Co—W alloy electroplated steel sheet, on which a plating layer is formed by electroplating the steel in the electrolyte.

16 Claims, No Drawings

ZN-CO-W ALLOY ELECTROPLATED STEEL SHEET WITH EXCELLENT CORROSION RESISTANCE AND WELDABILITY, AND ELECTROLYTE FOR PLATING SAME

BACKGROUND OF THE INVENTION

1. Field of the Invention

The present invention relates to a Zn—Co—W alloy electroplated steel sheet and an electrolyte for manufacturing the same, and more particularly to a Zn—Co—W alloy electroplated steel sheet with excellent corrosion resistance and weldability, and an electrolyte for manufacturing the same in a stable manner.

2. Description of the Prior Art

In recent years, zinc plated steel sheet has been favored over competing steel sheets having other corrosion resistant surfaces and has been widely used for automobiles, household electric appliances and construction materials because of its excellent corrosion resistance. However, new plated steel sheets with high corrosion resistance by coatings in the form of a thin film are now required in terms of energy and resource savings. To meet these requirements, a Zn—Fe— and a Zn—Ni— alloy electroplated steel sheet have been developed and now are commercially available. In addition, a Zn—Cr alloy plated steel sheet has been developed.

However, as for a Zn—Fe alloy plated steel sheet, iron is contained in a plating layer which is formed on the steel sheet. Therefore, when the steel sheet is exposed to a corrosive atmosphere, the plating layer protects the steel sheet by sacrificial anticorrosive reaction. However, the plating layer is dissolved and then iron therein is oxidized to produce a red corrosive product. Final consumers consider it as a rusted steel sheet and thus tend to avoid the use of the Zn—Fe alloy plated steel sheet. Furthermore, there is a disadvantage in that ferrous ion is oxidized to ferric ion, thereby forming sludge during manufacturing the Zn—Fe alloy plated steel sheet.

As for a Zn—Ni alloy plated steel sheet, it is widely used as a material of automobiles due to its excellent corrosion resistance. However, because humans have been known to experience an allergic reaction to nickel, use of nickel-plated products has been prohibited in Europe. This trend continues to spread all over the world.

A Zn—Cr alloy plated steel sheet is markedly better than a Zn—Fe or a Zn—Ni plated steel sheet in terms of corrosion resistance and can obtain desired corrosion resistance even though a thin film of plating is applied to the steel sheet. In spite of these advantages, plating efficiency is low and thus production cost is high. Furthermore, chromium is harmful in the human body and thus its use is prohibited according to the environmental acts and regulations. Accordingly, it is difficult to use it practically.

As for a chromate surface treated steel sheet to improve corrosion resistance of zinc plated steel sheets, it does not have sufficient corrosion resistance to be used as a steel sheet for automobiles. Besides, chromium on the surface of the steel sheet is vaporized during a process of manufacturing automobiles, thereby causing damage to the human body. Therefore, its use has now been prohibited.

Accordingly, there is need to develop new alloy plated steel sheets with excellent corrosion resistance which are less hazardous to the human body.

An alloy electroplated steel sheet developed for these purposes is disclosed in U.S. Pat. No. 3,791,801. The patent discloses an electroplated steel sheet with excellent corrosion resistance, in which 0.05–2 weight % of one or more of molybdenum oxides or tungsten oxides are present in a zinc plating layer, or 0.05–2 weight % of one or more of molybdenum oxides or tungsten oxides and 0.5–15 weight % of metals or oxides of Fe, Ni, Co, Sn, Pb, etc. are co-deposited in the zinc plating layer.

In the above U.S. Pat. No. 3,791,801, the molybdenum and tungsten are present as their colloidal oxides in an acidic electrolyte. The molybdenum and tungsten oxides are physically filled in or are adsorbed chemically on a plating layer during plating, thereby being present as oxides such as $MoO_2$, $Mo_2O_3$, $WO_2$ and $W_2O_3$, or hydroxides in the plating layer. If the molybdenum or tungsten oxide is present in the plating layer, the oxide is effective to restrain the dissolution of zinc under corrosive conditions, thereby enhancing corrosion resistance. In addition, if the oxide is present on the surface of the plating layer, the oxide adheres tightly to the paint layer, ensuring excellent adhesion after painting A zinc plated steel sheet comprising oxides such as $MoO_2$, $Mo_2O_3$, $WO_2$, $W_2O_3$, etc. in a plating layer, is known to be useful in electric household appliances requiring corrosion resistance and paintability. However, because Mo or W is not present as alloy with zinc but is individually present as an oxide, when spot welding is carried out, for example, in a car body, there is a problem in that the oxide present on the surface of the plating layer can inhibit the flow of current and thus lower weldability. In particular, recently, automobile manufacturing companies have used mainly a projection welding method, in which several electrode tips are mounted, thereby being capable of carrying out the spot welding at the several electrode tips at one time. In this case, electric resistance must be uniform throughout a steel sheet, so that uniform welding at all electrode tips is accomplished.

Accordingly, as for a steel sheet, in which oxide such as $MoO_2$, $Mo_2O_3$, $WO_2$ or $W_2O_3$ or the like is present at the steel sheet surface and a plating layer which is formed on the steel sheet, due to high electric resistance of the plating layer, it is necessary to apply higher current for normal welding. However, when higher current is applied, zinc is quickly vaporized, so as to shorten the life of electrode tips; at the same time, spatter, a phenomenon that small droplets are dispersed to adjacent areas, is generated.

Furthermore, when there are differences in oxide content among sections of the steel sheet, electrical resistance among the sections is different. As a result, current passes toward the electrode tips with low electrical resistance during projection welding, but does not pass toward the electrode tips with high electrical resistance. Consequently, welding is not achieved.

Still furthermore, when oxide such as $MoO_2$, $Mo_2O_3$, $WO_2$, or $W_2O_3$, or the like is present in a zinc plating layer, binding force of metallic zinc with the oxide is weak. As a result, a plating material is stripped off as fine powder during bending of the steel sheet. This phenomenon is what is called "powdering". When powdering occurs, there is a problem in that after the bending, the sections where powdering occurs are not provided for the substrate protection, thereby lowering corrosion resistance.

Meanwhile, Japanese Patent Laid-Open Publication No. 57-114686 discloses a technique, by which citric acid, formic acid and tartaric acid are added to an acidic electrolyte, to prevent tungsten and molybdenum, etc. from forming colloidal oxide sludge in the acidic electrolyte. As described in the publication, a glossy zinc electroplated steel sheet is manufactured using an electrolyte containing zinc ion as a main component, one or more of Co, Mo, Ni, Fe, Cr, W, V, In, Sn, and Zr ions, and an organic additive. Addition of citric acid, formic acid, and tartaric acid to the electrolyte makes it possible to prevent sludge formation of the metal ions and thus to reduce the amount of the sludge. As a result, workability in plating is enhanced and loss of effective metal ions in the electrolyte is reduced.

As can be seen from the FIG. 1 and FIG. 2 in the publication, the amount of sludge was reduced in the electrolyte containing citric acid, formic acid, and tartaric acid, compared with the electrolyte in the absence of them. However, the formation of sludge was not completely prevented.

Generally, when a steel strip is continuously electroplated, as plating proceeds, the concentration of a variety of metal ions in an electrolyte is reduced. Therefore, the reduced amount must be replenished, so that a plating layer with uniform metal ion content can be stably formed on a steel sheet.

As for the above publication, in the same manner, as plating proceeds, the concentration of metal ions in an electrolyte is reduced. In order to maintain the concentration uniformly, metal salts must be injected from the outside periodically. However, whenever the metal salts are injected, a small amount of sludge is formed. The formed sludge must be removed by a filter apparatus or by a dissolution apparatus. Unless the sludge is removed, it continues to be present in an electrolyte. Consequently, as plating proceeds, an amount of the sludge in the electrolyte becomes large.

When colloidal tungsten oxide is even slightly present in an electrolyte for manufacturing a Zn—Co—W alloy plated steel sheet, there are problems in that the tungsten oxide is co-deposited on a plating layer, thereby deteriorating weldability, and the binding force of the tungsten oxide with metallic zinc and/or cobalt is weak, thereby the plating layer being stripped off in the form of powder during bending. As described in the above, the technique presented in the above publication cannot completely prevent formation of sludge in an electrolyte. As a result, tungsten oxide, etc. is electrodeposited on the plating layer during electroplating, and thus a plated steel sheet with excellent corrosion resistance and weldability cannot be efficiently manufactured.

SUMMARY OF THE INVENTION

Therefore, the present invention has been made in view of the above problems, and it is an object of the present invention to provide a Zn—Co—W alloy electroplated steel sheet with excellent corrosion resistance and weldability, in which by alloy plating the steel sheet with metallic zinc, cobalt and tungsten in an appropriate ratio, a plating layer consisting of zinc, cobalt and tungsten is formed on the steel sheet.

It is another object of the present invention to provide an electrolyte for manufacturing the Zn—Co—W alloy electroplated steel sheet, in which the steel sheet is plated with metallic zinc, cobalt and tungsten in an appropriate ratio, whereby tungsten component of the alloy is metallic tungsten.

DETAILED DESCRIPTION OF THE INVENTION

As for tungsten ion in an aqueous solution, it is known that $WO_4^{2-}$ ion is stable in pH of about 7 or more, $(HW_6O_{21})^{5-}$ where pH is 4–7, $(H_3W_6O_{21})^{3-}$ where pH is 3–4, and $(W_{12}O_{39})^{6-}$ where pH is 3 or less. When tungstate, $Na_2WO_4$, $K_2WO_4$ or $(NH_4)_2WO_4$ is dissolved and stored in water, as time goes by, sludge is generated at pH 4 or less. As pH is lower, sludge generation velocity increases.

If the tungstate is dissolved in an electrolyte containing Zn ion and Co ion, unlike in water, sludge is generated above pH 3. As pH is higher, sludge generation velocity increases. We assume that the tungstate binds with $Zn^{2+}$ and $Co^{2+}$ ions to generate sludge. However, the complete reaction mechanism is not known. Accordingly, when electroplating is carried out in a plating bath containing Zn ion, Co ion and W ion below pH 6, tungsten oxide such as $WO_2$ or $W_2O_3$ is applied to a plating layer, as described in the U.S. Pat. No. 3,791,801.

On the other hand, where tungsten is present as oxide on a plating layer, the tungsten oxide on the surface of the plating layer adheres closely to the plating layer, ensuring excellent adhesion. However, where the oxide is present inside the plating layer, the stress of the plating layer becomes large and the binding force of the oxide with plating layer components becomes weak. As a result, the plating layer tends to be stripped off during bending of a steel sheet and spot weldability is poor.

Accordingly, the inventors have repeatedly studied and experimented so as to plate a steel sheet with metallic tungsten, using a zinc-cobalt-tungsten plating alloy. As a result, they found that when citric acid was added to an electrolyte in an appropriate amount, almost all of the tungsten formed a complex compound with the citric acid, thereby permitting the plating to be carried out with metallic tungsten in contrast to tungsten oxide.

In accordance with one aspect of the present invention, there is provided a Zn—Co—W alloy electroplated steel sheet with excellent corrosion resistance and weldability, in which a plating layer consisting of Co: 0.1–3.0 weight %, W: 0.1–2.0 weight % and Zn: balance, is formed on the steel sheet, and the tungsten component of the alloy is metallic tungsten.

In accordance with another aspect of the present invention, there is provided an electrolyte for manufacturing the Zn—Co—W alloy electroplated steel sheet, comprising zinc chloride: 60–200 g/l, cobalt chloride: 0.1–6.0 g/l, tungsten: 0.1–4.0 g/l, citric acid: 0.5–10.0 g/l, polyethylene glycol: 0.1–2.0 ml/l and electric conductive aid: 30–400 g/l, in which almost all ions of the tungsten form a complex compound with the citric acid, thereby preventing formation of sludge.

In accordance with yet another aspect of the present invention, there is provided a Zn—Co—W alloy electroplated steel sheet, on which a plating layer is formed by Zn—Co—W alloy electroplating using the electrolyte.

Hereinafter, the electroplated steel sheet and electrolyte of the present invention will be illustrated by way of detailed description and examples which are non-limiting to the spirit and scope of the invention.

Electroplated Steel Sheet

As described in the above, as for the Zn—Co—W alloy electroplated steel sheet of the present invention, the plating layer consists of Co: 0.1–3.0 weight %, W: 0.1–2.0 weight %, and Zn: balance, and the tungsten component of the alloy is metallic tungsten.

That is, the content of cobalt present in the plating layer of the present invention is defined as 0.1–3.0 weight % (hereinafter, % only) as calculated for metallic cobalt. If the content of cobalt is 0.1% or less, corrosion resistance is poor, while if it exceeds 3.0%, corrosion resistance is excellent but the cost of cobalt is high. Therefore, the use of more than 3.0% cobalt is not economical.

The content of the tungsten present in the plating layer of the present invention is defined as 0.1–2.0%. If the tungsten content is 0.1% or less, corrosion resistance is poor, while if it exceeds 2.0%, powdering occurs on the plating layer.

The present invention is characterized in that the tungsten is present in the plating layer in the form of metallic tungsten, not tungsten oxide. The tungsten, along with the zinc and cobalt, forms an alloy. As a result, corrosion resistance is enhanced and spot welding is improved.

As described above, if 0.1–3% of metallic cobalt and 0.1–2.0% of metallic tungsten are present in the plating layer, a Zn—Co—W alloy present in the plating layer acts as a barrier against corrosion, ensuring markedly improved corrosion resistance. At the same time, all the tungsten in the plating layer is present as metallic tungsten, and thus spot weldability is excellent and powdering, heretofore caused during forming operations, does not occur.

Electrolyte

Hereinafter, an electrolyte for manufacturing the Zn—Co—W alloy electroplated steel sheet of the present invention will be described in detail.

The concentration of zinc chloride in the electrolyte of the present invention is defined as 60–200 g/l. If the concentration of zinc chloride is 60 g/l or less, a continuous high current density plating is impossible, while if it exceeds 200 g/l, zinc chloride remains undissolved, thereby zinc salt being deposited.

The concentration of cobalt chloride in the electrolyte is defined as 0.1–6.0 g/l. When the cobalt chloride is at least 0.1 g/l, the cobalt content in the electrolyte can be stably maintained above 0.1%. The reason why the upper limit is 6.0 g/l, is that the value is sufficient for obtaining 0.1–3 wt % of cobalt content in the plating layer.

The electrolyte of the present invention comprises 0.1–4.0 g/l of tungsten. When the tungsten concentration is at least 0.1 g/l, the tungsten content of 0.1% or more is stably secured in the plating layer. Furthermore, the reason why the upper limit is 4.0 g/l, is that the value is sufficient for obtaining 0.1–2% of tungsten content in the plating layer.

In accordance with the present invention, the tungsten is preferably added in the form of one or more soluble tungstates selected from sodium tungstate, ammonium tungstate and potassium tungstate.

The electrolyte of the present invention comprises 0.5–10.0 g/l of citric acid. Preferably, the citric acid is added in the form of one or more soluble citrates selected from sodium citrate, ammonium citrate and potassium citrate.

The citric acid serves to prevent tungstate from being deposited in the form of colloidal tungsten oxide. However, if the concentration of the citric acid is 0.5 g/l or less, as time goes by, tungsten oxide is deposited. If the concentration exceeds 10.0 g/l, plating is not affected. However, because the use of only 10.0 g/l of citric acid is sufficient for preventing deposition of colloidal tungsten oxide, the addition of citric acid of 10.0 g/l or more is not economical.

If citric acid is not added to the electrolyte of the present invention, or if 0.5 g/l or less of citric acid is added, tungsten in the electrolyte is present in the form of tungsten oxide. Therefore, tungsten in a zinc plating layer is present in the form of an oxide by physical reclamation or chemical adsorption during plating.

In the electrolyte of the present invention, almost all tungsten bonds with citric acid to form a complex compound. Specifically, almost all tungsten bonds with citric acid to form a complex compound in the electrolyte of the present invention, so as to prevent part or all of the tungsten from forming microcolloidal sludge. As a result, tungsten plating can be carried out with metallic tungsten.

The manner in which citric acid is added to the electrolyte for practicing the present invention is very important. If soluble tungstate is added to the electrolyte, followed by citric acid, part or all of the tungsten forms colloidal sludge. Subsequently, even though the citric acid is added, the produced tungsten sludge is not dissolved and thus is co-deposited in a plating layer, causing the deterioration of weldability of the plated steel sheet. Hence, the sequence of addition of the constituents is important.

With respect to the sequence of addition, in case citric acid precedes tungsten, or both of them are added simultaneously, part of the added tungsten inevitably forms sludge before reacting with the citric acid.

The present invention was brought to fruition by paying attention to this sequencing point. In accordance with the present invention, soluble tungstate and citric acid are dissolved in water, so that almost all of the tungsten can form a complex compound with the citric acid. That is, soluble tungstate and citric acid are simultaneously dissolved in water to sufficiently form a complex compound. Then, the addition of the complex compound to an electrolyte prevents tungsten from forming sludge before reacting with citric acid.

As plating proceeds, the tungsten concentration in an electrolyte reduces. When the reduced amounts of tungsten are replenished, citric acid and tungstate are dissolved in water to form a complex compound and then the solution containing the complex compound is injected into the electrolyte, thereby preventing formation of sludge.

In accordance with the present invention, in order to enhance the smoothness of a plating layer, polyethylene glycol is added. However, if the concentration of the polyethylene glycol is too little, the plating layer is roughened and thus its appearance is poor after plating. If the concentration is excessive, there is no problem in plating workability and the quality of a plated steel sheet. However, the addition of excessive concentration is not economical. Considering this fact, the concentration of the polyethylene glycol to be added is defined as 0.1–2.0 ml/l.

Preferably, a polyethylene glycol with molecular weight of 100–2000 is used.

Further, in accordance with the present invention, the concentration of an electric conductive aid in the electrolyte is defined as 30–400 g/l. The electric conductive aid serves to enhance electric conductivity of the electrolyte. As for continuous plating equipment operating in a high current density, at least 30 g/l of the electric conductive aid must be added, so as to manufacture products stably. If the concentration of the electric conductive aid exceeds 400 g/l, the electric conductive aid can be deposited when a temperature of the electrolyte is low.

In accordance with the present invention, potassium chloride, ammonium chloride, and sodium chloride, alone or a mixture, can be used as the electric conductive aid.

More preferably, the pH of the electrolyte is defined as 3–6. If the pH is below 3, plating efficiency is low, but if the pH exceeds 6, zinc ion and cobalt ion can be deposited in the form of hydroxide.

Preparation of Plated Steel Sheet

The plated steel sheet of the present invention can be readily manufactured by a general method comprising the steps of: using a conventional cold rolled steel sheet as a base iron, degreasing, washing, acid washing, and then electroplating the steel sheet in an electrolyte.

In other words, by electroplating a steel sheet using a conventional method in the electrolyte prepared as above, a plating layer consisting of Co: 0.1–3.0 wt %, W: 0.1–2.0 wt % and zinc: balance, is formed on the steel sheet. The tungsten plating is carried out with metallic tungsten. As a result, a Zn—Co—W alloy electroplated steel sheet with excellent corrosion resistance and weldability can be manufactured in a stable manner.

The present invention is not limited to the illustrated plating conditions. Provided that a plating layer consisting of the aforementioned components can be obtained in the aforementioned electrolyte, any plating conditions can be within the range of the present invention.

Hereinafter, the present invention will be illustrated by way of examples.

EXAMPLES

Zn—Co—W alloy electrolytes each having the composition as shown in Table 1 were prepared. By using various tungstate addition methods, i.e. A–D, the extent of formation of complex compounds of tungstate ions and citrate ions in final electrolyte were varied. Specifically, A describes a method wherein tungstate is injected so as to ensure that all tungstate ions form complex compounds with citrate ions in an electrolyte, and B–E are methods whereby part or all of tungstate ions form sludge in an electrolyte.

In the present experiments, zinc and cobalt were added in the form of zinc chloride and cobalt chloride to an electrolyte, tungsten was added in the form of sodium tungstate, and citric acid was added in the form of sodium citrate. In addition to the above, 250 g/l of potassium chloride was added as an electric conductive aid, polyethylene glycol with molecular weight of 600 was used as an additive, and the pH of an electrolyte was 5.

Each electrolyte prepared as above was stored at a temperature of 60° C., for 72 hours, under mechanical stirring, and then used for electroplating a conventional cold rolled steel sheet with a thickness of 0.8 mm which had been degreased and acid washed. At this time, a temperature of the final electrolyte was 60° C., a current density was 60 A/dm$^2$, and a plating weight was 40 g/m$^2$.

The compositions of the plating layers of cold rolled steel sheets plated in the above electrolytes were analyzed quantitatively, and then the contents of cobalt and tungsten were measured. The results are shown in Table 1. In addition, 50 ml of each of the electrolytes which had been stored for 72 hours was collected, put into a 50 ml Mass Cylinder, and stored for 5 hours without stirring, and the amount of sludge settling to the bottom of the Mass Cylinder was measured. Analysis confirmed that the sludge was tungsten oxide.

TABLE 1

| Sample | | Composition of electrolyte | | | | | Injection method of tungstate | Amount of sludge (ml/l) | Composition of plating layer | |
|---|---|---|---|---|---|---|---|---|---|---|
| | | $ZnCl_2$ (g/l) | $CoCl_2$ (g/l) | W (g/l) | Citric Acid (g/l) | PEG (ml/l) | | | Co (wt %) | W (wt %) |
| Inventive example | 1 | 80 | 0.1 | 0.1 | 0.5 | 0.2 | A | 0 | 0.11 | 0.14 |
| | 2 | 100 | 0.5 | 0.5 | 0.5 | 0.2 | A | 0 | 0.38 | 0.52 |
| | 3 | 100 | 1 | 0.5 | 0.5 | 0.5 | A | 0 | 0.75 | 0.57 |
| | 4 | 120 | 1 | 1 | 0.5 | 0.5 | A | 0 | 0.71 | 0.94 |
| | 5 | 150 | 1 | 3 | 3 | 0.5 | A | 0 | 0.63 | 1.72 |
| | 6 | 150 | 3 | 0.5 | 3 | 1 | A | 0 | 1.81 | 0.49 |
| | 7 | 150 | 3 | 1 | 5 | 1 | A | 0 | 1.93 | 1.03 |
| | 8 | 150 | 3 | 2 | 5 | 1 | A | 0 | 1.97 | 1.47 |
| | 9 | 150 | 4 | 4 | 5 | 1 | A | 0 | 2.59 | 1.94 |
| | 10 | 200 | 6 | 2 | 10 | 2 | A | 0 | 2.94 | 1.49 |
| | 11 | 150 | 2 | 2 | 2 | 1 | A | 0 | 1.22 | 1.46 |
| Comparative example | 1 | 150 | — | — | — | — | — | 0 | — | — |
| | 2 | 80 | 0.05 | 0.3 | 1 | 0.5 | A | 0 | 0.06 | 0.35 |
| | 3 | 150 | 8 | 0.5 | 1 | 1 | A | 0 | 3.91 | 0.58 |
| | 4 | 150 | 1 | 0.05 | 1 | 1 | A | 0 | 0.62 | 0.03 |
| | 5 | 150 | 1 | 6 | 4 | 1 | A | 0 | 0.67 | 2.65 |
| | 6 | 150 | 1 | 3 | 0 | 1 | — | 220 | 0.53 | 1.11 |
| | 7 | 150 | 1 | 3 | 0.3 | 1 | A | 10 | 0.51 | 1.39 |
| | 8 | 150 | 2 | 2 | 2 | 1 | C | 45 | 1.23 | 1.14 |
| | 9 | 150 | 2 | 2 | 2 | 1 | B | 14 | 1.25 | 1.22 |
| | 10 | 150 | 2 | 2 | 2 | 1 | D | 87 | 1.24 | 1.1 |
| | 11 | 150 | 2 | 2 | 2 | 1 | E | 165 | 1.23 | 0.93 |
| | 12 | 150 | 2 | 2 | 2 | 0.05 | A | 0 | 1.35 | 1.49 |
| | 13 | 150 | 2 | 2 | 2 | — | A | 0 | 1.29 | 1.47 |

Injection method of tungstate:

A: dissolution of the citrate and tungstate together in water, followed by injection into an electrolyte.

B: injection and then dissolution of citrate in an electrolyte, followed by dissolution of tungstate in water and then injection into the electrolyte.

C: injection and then dissolution of citrate in an electrolyte, followed by direct injection of tungstate into the electrolyte.

D: direct injection of citrate and tungstate into an electrolyte.

E: addition and then dissolution of tungstate in an electrolyte, followed by addition of citrate to the electrolyte.

Plated samples were analyzed, using X-ray photoelectron spectrometer, to determine whether tungsten co-deposited in a plating layer is oxide or metal. The results are shown in Table 2.

Further, the degree of surface smoothness was evaluated by examining the plating layers of the samples with the naked eyes. Specifically, the rating was as follows: ◎: very smooth, ○: smooth, Δ: rough, and x: very rough. Corrosion resistance of a plating layer was evaluated by salt spray test, measuring the time when red rust was generated on a steel sheet.

To evaluate the weldability of the samples, spot welding was carried out by overlapping plating layers with increasing current. The current at the time when a welded portion begins to melt is defined as the weldable minimum current, and the current at the time immediately before spatter phenomenon occurs is defined as the weldable maximum current. The difference between the minimum current and maximum current is defined as weldable current. The mean weldable current of both the currents is defined as optimum weldable current. Weldability is evaluated to be good, as the optimum current is lowered, or as the width of the weldable current is broadened, as shown in Table 2. Specifically, the rating of weldability is as follows: ◎: good, Δ: poor, x: very poor.

To evaluate powdering resistance of a plating layer, adhesive vinyl tape was attached on a plated steel sheet, then the sheet was bent at an angle of 180° and returned to its original state, followed by detaching the tape from the plated steel sheet. The powdering resistance was evaluated according to how much plating material stuck to the tape, as shown in Table 2. The rating of powdering occurrence is as follows: ◎: no occurrence, Δ: little occurrence, and x: much occurrence.

TABLE 2

| Sample | | The form of tungsten co-deposited on plating layer | Smoothness of plating layer | Powdering of plating layer | Corrosion resistance (red rust generation time) | Weldability |
|---|---|---|---|---|---|---|
| Inventive Example | 1 | Metal tungsten | ○ | ◎ | 155 | ◎ |
| | 2 | Metal tungsten | ◎ | ◎ | 245 | ◎ |
| | 3 | Metal tungsten | ◎ | ◎ | 330 | ◎ |
| | 4 | Metal tungsten | ◎ | ◎ | 375 | ◎ |
| | 5 | Metal tungsten | ◎ | ◎ | 470 | ◎ |
| | 6 | Metal tungsten | ◎ | ◎ | 290– | ◎ |
| | 7 | Metal tungsten | ◎ | ◎ | 450 | ◎ |
| | 8 | Metal tungsten | ◎ | ◎ | 500 | ◎ |
| | 9 | Metal tungsten | ◎ | ◎ | 650 | ◎ |
| | 10 | Metal tungsten | ◎ | ◎ | 580 | ◎ |
| | 11 | Metal tungsten | ◎ | ◎ | 520 | ◎ |
| Comparative Example | 1 | — | ○ | ◎ | 65 | ◎ |
| | 2 | Metal tungsten | ◎ | ◎ | 112 | ◎ |
| | 3 | Metal tungsten | ◎ | ◎ | 350 | ◎ |
| | 4 | Metal tungsten | ◎ | ◎ | 75 | ◎ |
| | 5 | Metal tungsten | ◎ | x | 630 | ◎ |
| | 6 | Tungsten oxide | ○ | x | 160 | x |
| | 7 | Metal tungsten + Tungsten oxide | ◎ | Δ | 200 | Δ |
| | 8 | Metal tungsten + Tungsten oxide | ○ | Δ | 190 | Δ |
| | 9 | Metal tungsten + Tungsten oxide | ◎ | Δ | 220 | Δ |
| | 10 | Metal tungsten + Tungsten oxide | ◎ | Δ | 180 | x |
| | 11 | Tungsten oxide | ◎ | x | 160 | x |
| | 12 | Metal tungsten | Δ | ◎ | 500 | ◎ |
| | 13 | Metal tungsten | x | ◎ | 430 | ◎ |

As shown in Tables 1 and 2, as for the inventive examples (1–11), the added amount of zinc chloride, cobalt chloride, etc. was suitably controlled, citrate and tungstate were simultaneously dissolved in water and then were injected into an electrolyte. As a result, all the tungsten ions, along with the citric acids, formed a complex compound and no tungsten oxide sludge was generated in the electrolyte.

Where plating was carried out using the electrolytes prepared as above, the content of cobalt and tungsten in a plating layer after plating can be controlled to be 0.1–3.0% and 0.1–2.0%, respectively. Furthermore, all the tungsten co-deposited in the plating layer was deposited in the form of metallic tungsten.

The inventive plated steel sheets had very smooth or smooth plating surfaces. Red rust generation time was 155 hours or more. Accordingly, corrosion resistance was good. Because all the tungsten contained in the plating layer was present in the form of metal, powdering did not occur. Accordingly, weldability was good.

Contrary to the inventive examples, comparative example 1 is a zinc plated steel sheet, in which only zinc chloride and potassium chloride are added to an electrolyte and then plating is carried out in the electrolyte. The surface of the plating layer was relatively smooth, but red rust generation time was 65 hours, showing the poor corrosion resistance.

In comparative example 2, the concentration of cobalt chloride is lower than that of the present invention. No sludge formed in an electrolyte. A plating layer was very smooth and weldability was good, but corrosion resistance was poor.

In comparative example 3, the concentration of cobalt chloride is higher than that of the present invention. A plating layer was smooth, powdering did not occur, and weldability and corrosion resistance were good. However, if cobalt in excess of the range of the present invention is co-deposited on the plating layer, the quality of a plated steel sheet can be good, but such excessive addition is unfavorable for economic reasons, that is, cobalt is relatively expensive.

In comparative example 4, the concentration of tungsten in the electrolyte is lower than that of the present invention. The content of the tungsten co-deposited on the plating layer was lower than that of the present invention, thereby the corrosion resistance was poor. In comparative example 5, the concentration of tungsten is higher than that of the present invention. Accordingly, the content of tungsten co-deposited on the plating layer was larger, resulting in excessive toughness of the plating layer and thus much occurrence of powdering.

In comparative example 6 with no citric acid, a large amount of tungsten oxide sludge was generated (220 ml/l). Therefore, the tungsten oxide was applied to a plating layer. Although the composition of the plating layer is in the range of the present invention, bonding force of the tungsten oxide with metallic zinc and cobalt in the plating layer was very low and thus much powdering occurred during bending of a plated steel sheet. Besides, in spot welding, weldability was very poor, because the tungsten oxide present in the plating layer blocks the flow of current.

In comparative examples 12 and 13, the concentration of a polyethylene glycol additive in an electrolyte is outside the range of the present invention, or the additive is not added. The smoothness of the plating layer surface was poor.

On the other hand, as for comparative examples 7–11, part of tungsten ions do not form a complex compound with citric acid and become a tungsten oxide, thereby producing sludge. If plating is carried out in the electrolyte, part of tungsten in a plating layer cannot but be deposited in the form of tungsten oxide.

In comparative example 7, the concentration of citric acid is lower than that of the present invention. 10 ml/l of tungsten oxide sludge was generated in an electrolyte and metallic tungsten and tungsten oxide coexisted in a plating layer, whereby powdering occurred and weldability was poor.

In comparative example 8, the composition of an electrolyte is in the range of the present invention. However, citrate is injected into an electrolyte, and then tungstate is injected thereinto. When the tungstate was dissolved in the electrolyte, the part thereof formed tungsten oxide. As a result, 45 ml/l sludge was generated. Therefore, metallic tungsten and tungsten oxide coexisted in a plating layer. Because the bonding force of the tungsten oxide with metallic zinc and cobalt was weak, powdering occurred and weldability was poor.

Comparative example 9 has the composition of an electrolyte in the range of the present invention. However, citrate is injected and dissolved completely in an electrolyte, followed by dissolution of tungstate in water and injection of the resultant into the electrolyte. Even though less than in the comparative example 8, 14 ml/l of tungsten oxide sludge was generated in the electrolyte. We assume that when tungstate is added to an electrolyte containing citric acid, during the formation process of a complex compound of the tungstate with the citric acid, part of the tungstate is changed into tungsten oxide.

Comparative example 10 has the composition of an electrolyte in the range of the present invention, but citrate and tungstate are simultaneously and directly injected into an electrolyte. 87 ml/l sludge was generated in the electrolyte. As a result, metallic tungsten and tungsten oxide coexisted in a plating layer, whereby much powdering occurred and weldability was poor.

Comparative example 11 has the composition of an electrolyte in the range of the present invention. However, tungstate was injected into an electrolyte and then dissolved, followed by direct injection and then dissolution of citric acid. Because the tungstate is dissolved in an electrolyte with no citric acid to form tungsten oxide, followed by the addition of citrate, 165 ml/l sludge was generated in an electrolyte. As a result, tungsten oxide was present in a plating layer, whereby much powdering occurred and weldability was poor.

The examples are illustrative examples of the present invention, which are not intended to be limiting. Although the preferred embodiments of the present invention have been disclosed for illustrative purposes, those skilled in the art will appreciate that various modifications, additions and substitutions are possible, without departing from the scope and spirit of the invention as disclosed in the accompanying claims.

Industrial Applicability

As apparent from the above description, the present invention can stably manufacture a Zn—Co—W alloy electroplated steel sheet with excellent corrosion resistance and weldability, in which by optimizing an electrolyte composition and then alloy plating the steel sheet with metallic zinc, cobalt and tungsten in an appropriate ratio in the electrolyte, a plating layer consisting of zinc, cobalt and tungsten is formed on the steel sheet.

What is claimed is:

1. A Zn—Co—W alloy electroplated steel sheet with excellent corrosion resistance and weldability having a plating layer, the plating layer consisting of Co: 0.1–3.0 wt %, W: 0.1–2.0 wt %, and zinc: balance, all tungsten plating being carried out with metallic tungsten.

2. An electrolyte for manufacturing a Zn—Co—W alloy electroplated steel sheet, comprising zinc chloride: 60–200 g/l, cobalt chloride: 0.1–6.0 g/l, tungsten: 0.1–4.0 g/l, citric acid: 0.5–10.0 g/l, polyethylene glycol: 0.1–2.0 ml/l and electric conductive aid: 30–400 g/l, almost all ions of the tungsten forming a complex compound with citric acid, thereby preventing formation of sludge.

3. The electrolyte for manufacturing a Zn—Co—W alloy electroplated steel sheet as set forth in claim 2, wherein the tungsten is added in the form of one or more tungstates selected from sodium tungstate, ammonium tungstate and potassium tungstate.

4. The electrolyte for manufacturing a Zn—Co—W alloy electroplated steel sheet as set forth in claim 2, wherein the citric acid is added in the form of one or more citrates selected from sodium citrate, ammonium citrate and potassium citrate.

5. The electrolyte for manufacturing a Zn—Co—W alloy electroplated steel sheet as set forth in claim 2, wherein the electric conductive aid is potassium chloride, ammonium chloride, and sodium chloride, alone or a mixture.

6. The electrolyte for manufacturing a Zn—Co—W alloy electroplated steel sheet as set forth in claim 2, wherein pH of the electrolyte is 3–6.

7. A Zn—Co—W alloy electroplated steel sheet, on which a plating layer is formed by electroplating the steel sheet in the electrolyte of claim 2.

8. A Zn—Co—W alloy electroplated steel sheet, on which a plating layer is formed by electroplating the steel sheet in the electrolyte of claim 3.

9. A Zn—Co—W alloy electroplated steel sheet, on which a plating layer is formed by electroplating the steel sheet in the electrolyte of claim 4.

10. A Zn—Co—W alloy electroplated steel sheet, on which a plating layer is formed by electroplating the steel sheet in the electrolyte of claim 5.

11. A Zn—Co—W alloy electroplated steel sheet, on which a plating layer is formed by electroplating the steel sheet in the electrolyte of claim 6.

12. A method of making a Zn—Co—W alloy electroplated steel sheet having excellent corrosion resistance and weldability, said method comprising the steps of:

(a) providing a steel sheet to be plated;

(b) providing an electrolyte containing 60–200 g/l of zinc chloride; 0.1–6.0 g/l of cobalt chloride; 0.1–4.0 g/l of tungsten; 0.5–10.0 g/l of citric acid, wherein the tungsten is in the form of a water soluble tungstate and wherein the tungstate and citric acid are first dissolved in water and reacted to form a reaction compound prior to adding the reactor compound to the electrolyte; 0.1–2.0 ml/l of polyethylene glycol; and 30–400 g/l of an electric conductive;

(c) immersing the steel sheet in the electrolyte; and (d) electroplating the steel sheet with a plating layer comprising 0.1–3.0 wt % Co, 0.1–2.0 wt % W and balance zinc.

13. The method of claim 12, wherein the tungsten in the form of tungstate is one selected from the group consisting of sodium tungstate, ammonium tungstate and potassium tungstate.

14. The method of claim 12, wherein the polyethylene glycol has a molecular weight of between 100–2000.

15. The method of claim 12, wherein the electrolyte has a pH between 3 to 6.

16. A method of making an electrolyte for electroplating a steel sheet to prevent the formation of tungsten sludge, comprising the steps of:

(a) dissolving simultaneously a soluble tungstate form of tungsten and citric acid in water to form a complex compound; and (b) adding the complex compound from step (a) to an electrolyte containing 60–200 g/l of zinc chloride; 0.1–6.0 g/l of cobalt chloride; 0.1–2.0 ml/l of polyethylene glycol; 30–400 g/l of an electric conductive aid, to achieve a final tungsten concentration of 0.1–6.0 g/l and a citric acid concentration of 0.5–10.0 g/l.

* * * * *

UNITED STATES PATENT AND TRADEMARK OFFICE

CERTIFICATE OF CORRECTION

PATENT NO. : 6,677,057 B2
DATED : January 13, 2004
INVENTOR(S) : Myung-Su Kim

It is certified that error appears in the above-identified patent and that said Letters Patent is hereby corrected as shown below:

Column 3,
Before line 63, insert the following paragraph:

-- Because tungsten in an aqueous solution is present as $WO_4^{2-}$ ion, it is generally known that the tungsten plating cannot be carried out by an electroplating method. If tungsten plating, along with iron group metals such as Fe, Ni and Co, etc. is carried out, the plating is possible by way of co-deposition with the iron group metals. However, the mechanism of such plating is still not known. --

Signed and Sealed this

Eighteenth Day of May, 2004

JON W. DUDAS
*Acting Director of the United States Patent and Trademark Office*